United States Patent [19]

Goldbach

[11] 4,350,406

[45] Sep. 21, 1982

[54] SEPARABLE ELECTRICAL CONNECTOR MODULE

[75] Inventor: William R. Goldbach, Hickory, N.C.

[73] Assignee: General Electric Company, Philadelphia, Pa.

[21] Appl. No.: 224,404

[22] Filed: Jan. 12, 1981

[51] Int. Cl.[3] ..... H01R 13/52

[52] U.S. Cl. ..... 339/111; 200/144 R

[58] Field of Search ..... 339/111; 220/143 T, 220/143 R, 149 A

[56] References Cited

U.S. PATENT DOCUMENTS 4,119,358 10/1978 Tachick et al. ..... 339/111

4,175,817 11/1979 Tachick et al. ..... 339/111

*Primary Examiner*—Willie G. Abercrombie

*Attorney, Agent, or Firm*—William Freedman

[57] ABSTRACT

This separable electrical connector module comprises a piston upon which the gas generated during a fault-close operation acts to drive the bore contact of the module toward a mating rod contact, thereby facilitating fault-closing. The module further comprises a conductive tubular container having angularly-spaced keyribs on its bore. The piston is mounted within this bore and includes a tubular portion divided into a plurality of angularly-spaced segments that are biased radially-outwardly against the container bore in angularly-spaced locations between the keyribs. A split annular metal spring is located radially inwardly of the segments and has resilience normally tending to expand the spring in diameter and provide said radially-outwardly acting bias on the segments.

4 Claims, 4 Drawing Figures

60
30
32
15
62
58
56
54
14
46
38
10
12
18
52
67
64
66a
26
24
28
76
34
36
16
44
42
40
48
69
102
110
50

SEPARABLE ELECTRICAL CONNECTOR MODULE

CROSS-REFERENCE TO RELATED APPLICATION

The subject matter of this application is related to that of U.S. Pat. No. 4,175,817—Tachick et al, assigned to the assignee of the present invention, which patent is incorporated by reference in the present application.

BACKGROUND

This invention relates to a separable electrical connector module and, more particularly, to a module of this type that includes a bore contact and coupled thereto a piston upon which gas generated during a fault-closing operation acts to drive the bore contact toward a mating rod contact, thereby to facilitate fault-closing.

In the connector of the aforesaid Tachick et al patent, the piston is provided with angularly-spaced keyways that cooperate with stationary keyribs on the bore of a conductive tubular container to prevent rotation of the piston within the module. The keyribs in the Tachick et al patent are also utilized to carry current through the module and, for this purpose, cooperate with a thin outwardly-flared tubular portion of the piston. This tubular portion, being deformed radially-inwardly when the piston is inserted into the module, tends to expand radially outwardly against the keyribs, thus providing an electrical connection between the piston and the keyribs both while the piston is stationary and while moving within the conductive tubular container. This tubular portion is typically of a highly-conductive material such as copper. The spring characteristics of the copper are relied upon to develop contact pressure against the keyribs.

I have found that under certain high current conditions, the electrical connection between the keyribs and the outward-flared tubular portion of the piston is not as good as might be desired. The keyribs provide only relatively limited contact areas, and high currents flowing through these limited contact areas can develop high magnetic forces that sometimes separate the sliding contact areas and produce undesired arcing in these regions. Another factor contributing to this undesired effect is that when the copper of the tubular portion is stressed and subjected to elevated temperatures over a long time period, it tends to yield, and such yielding reduces the contact pressure.

SUMMARY

An object of my invention is to construct the piston of an electrical connector module in such a way that it can still cooperate with the keyribs in the surrounding tubular container but yet has available larger areas for sliding contact than were present with the above-described prior construction.

Another object is to provide a piston construction for a connector module in which substantially larger radially-outward forces are available than in the above-described prior construction for maintaining a good electrical connection between the piston and the surrounding conductive container.

Still another object is to provide a piston construction capable of fulfilling either or both of the preceding objects and also capable of maintaining the desired radially-outward forces without significant impairment from the elevated temperatures developed by currents through the electrical connections.

In carrying out my invention in one form, I divide the generally tubular piston portion into a plurality of angularly spaced segments that are biased radially-outwardly against the inside wall of the surrounding container tube in angularly-spaced locations between the keyribs. I also provide a split annular metal spring located radially inwardly of the segments, which spring has resilience normally tending to expand the spring in diameter and force the segments radially outward against the container wall. In one form of the invention, the segments are of copper and the spring ring is of a stainless steel having properties that are unaffected by the temperatures developed in this region.

BRIEF DESCRIPTION OF DRAWINGS

For a better understanding of the invention, reference may be had to the following specification taken together with the accompanying drawings, wherein.

DETAILED DESCRIPTION OF PREFERRED EMBODIMENT

Figure 1:
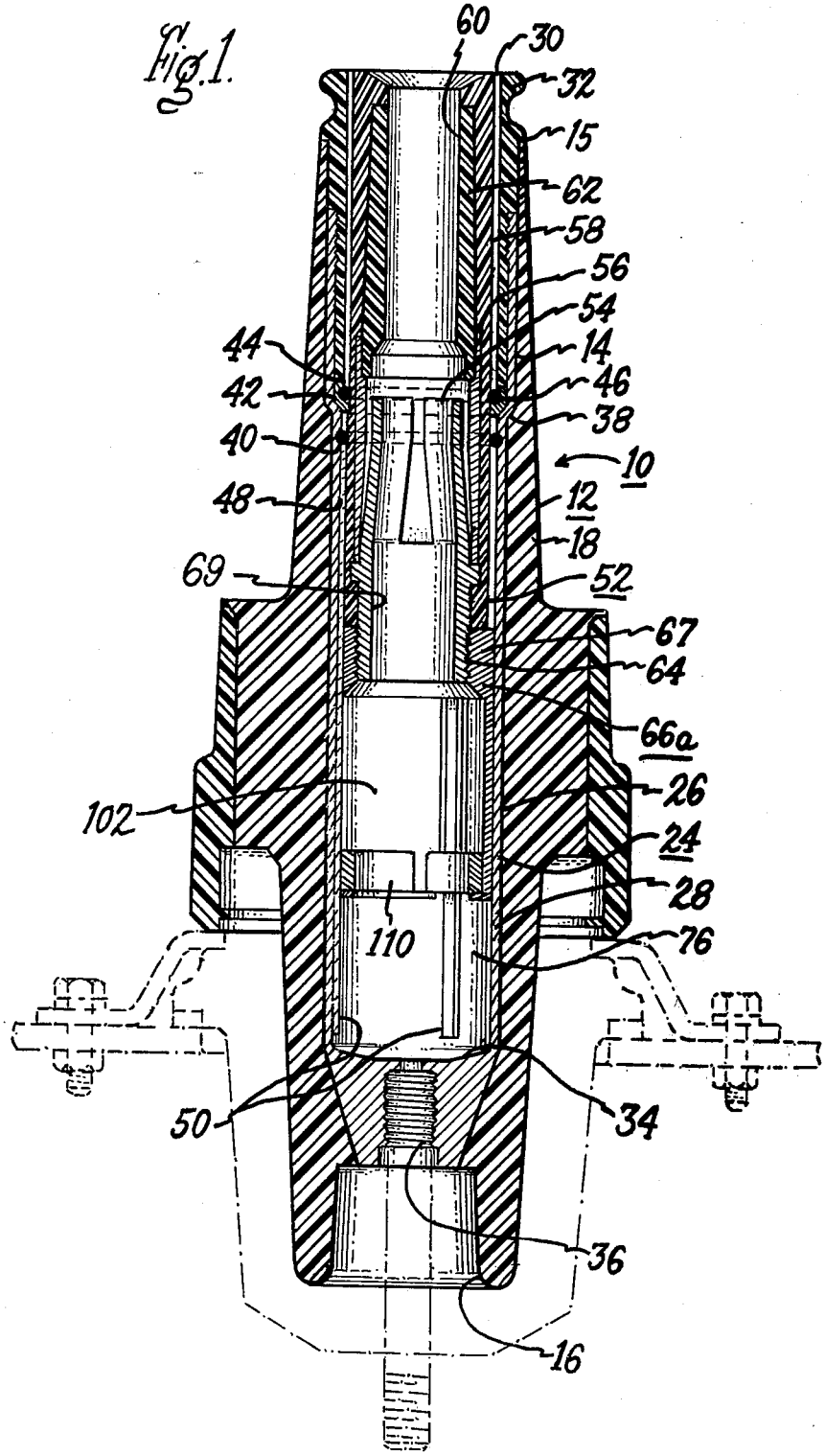
FIG. 1 is a sectional view through a separable connector module embodying one form of the invention.

The separable connector shown in FIG. 1 is in many respects similar to that shown and claimed in the aforesaid Tachick et al patent. Accordingly, the same reference numerals are used for the parts of FIG. 1 as are used for corresponding parts in the Tachick et al patent; and reference may be had to the Tachick et al patent for a detailed description of such parts. Generally speaking, where the parts have been fully described in the Tachick et al patent, they will not be described in the present application except insofar as deemed necessary to provide an understanding of the present invention. Emphasis in the present description will be placed on those features that are not shown in the Tachick et al patent.

In the separable connector module 10 of FIG. 1, there is a container tube 28 that has an interior wall, or bore, 48 that has three keyribs 50 formed in it. Each keyrib has a substantially rectangular cross-section and runs longitudinally of the tube from its inner end 34 to just below a retaining ring at 40 in the top half of the module. The keyribs 50 are equally spaced angularly about the axis of the container tube 28.

The container tube 28 is positioned within an elongated receiving passage 14 in the insulating housing 12. The bulk of the housing 12 is of elastomeric insulation that is molded around the container tube 28.

The piston upon which gas pressure acts during a fault-closing operation is shown at **66*a*. This piston 66*a* is slidably received within the container tube 28. At its upper end the piston 66*a* includes a cylindrical body portion 67 that contains in its outer periphery three angularly-spaced keyways that respectively receive the three angularly-spaced keyribs 50 on the bore of the surrounding conductive container tube 28**.

The piston **66*a* has a downwardly-extending generally tubular portion that comprises three angularly-spaced segments 102. These segments 102 are biased radially-outward into high pressure engagement with the bore of the container tube, contacting this bore in angularly-spaced locations between the keyribs. The segments 102 are preferably integral with the body portion 67 of the piston 66***a*, and both the body portion and the segments are made of copper. The entire piston is preferably tin plated so as to minimize the formation of copper oxides on its surface that could interfere with making a good electrical connection to the segments 102.

The segments 102 are biased radially outward into high pressure engagement with the surrounding container tube by means of a split annular spring ring 110. This spring ring 110 is located within the tube defined by segments 102 and has resilience that tends to expand the ring in diameter. This resilience acts upon the surrounding segments 102 to force them radially outward into high pressure engagement with the surrounding container tube 28.

Current flows through the module 10 via a path that extends upwardly from the bottom of the module through the container tube 28 and then into segments 102 of the piston 66*a* via the contacting regions between segments 102 and the container tube 28 in the vicinity of spring 110. The high pressure engagement between the segments 102 and the container tube 28 in this region provides a good electrical connection between these parts, as will be further described hereinafter. Although sufficient to provide for a good electrical connection, the engaging pressure is not sufficiently high to interfere with the desired upward movement of the piston under fault-close conditions, as is referred to hereinafter.

Figure 2:
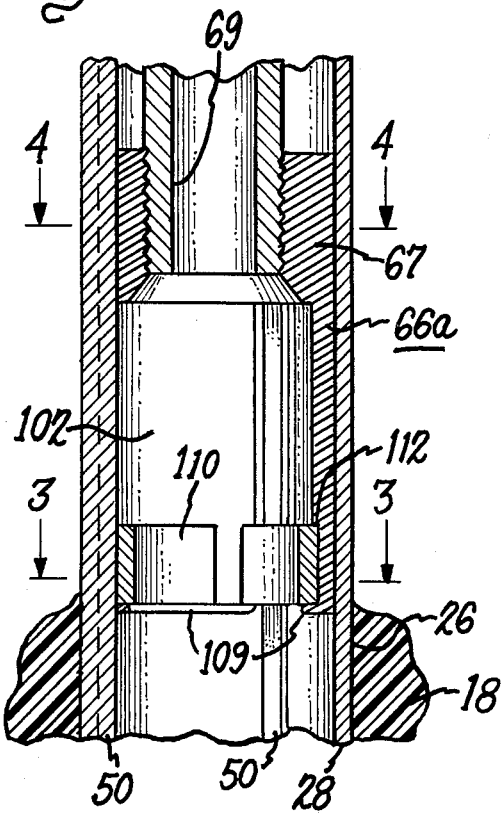
FIG. 2 is an enlarged view of a portion of FIG. 1.
Figure 4:
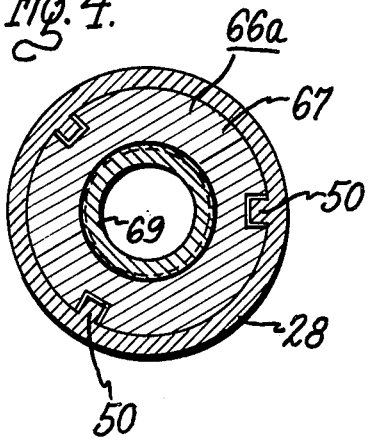
FIG. 4 is a sectional view along the line 4—4 of FIG. 2.
Figure 3:
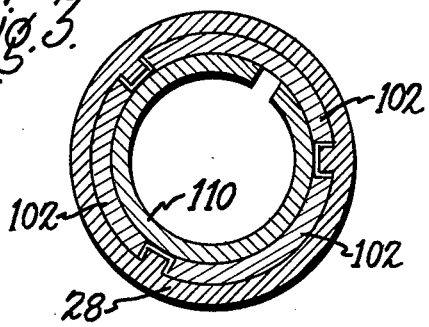
FIG. 3 is a sectional view along the line 3—3 of FIG. 2.

Referring to FIG. 2, the annular ring 110 is locked against axial movement with respect to the surrounding segments 102 by a radially inwardly extending lip 109 on the free ends of the segments. Each of the segments 102 has a recess at its lower end facing the bore of the piston, and these recesses collectively define an annular recess in the bore of the piston. In assembling the piston, the split annular spring ring 110 is pressed into this recess until one end engages a shoulder 112. Then the extreme outer ends of the segments are spun over in a radially inward direction to form the lip 109 that retains the spring ring against axial movement.

The spring ring 110 is preferably made of a stainless steel that has properties substantially unaffected by temperatures developed in this region as a result of currents flowing therethrough. This stainless steel spring ring is able to develop considerably higher radially-outward forces than was the case with the thin outwardly-flared tubular part 70 of the Tachick et al patent. Furthermore, there is more contact area available since contact is made in the less restricted regions between the keyribs rather than on the keyribs themselves. And still further, the higher radially-outward force is maintained unimpaired by high temperatures which might be developed in this region because the stainless steel spring, as compared to the previously-used copper tube, is less susceptible to having its spring properties degraded by such high temperatures.

Although the piston 66*a* of this module has been modified from that of the Tachick et al patent, the general operation of the module is basically the same as that of the Tachick et al patent. That is, an arc developed in the bore 60 of the snuffer line 62 of ablative material during a fault-close operation generates gases which pass downwardly through the central port 69 in the bore contact 54 and quickly build up a pressure beneath piston 66*a*. This pressure acts to drive the piston upwardly along with the bore contact 54 coupled thereto, thereby facilitating closing under fault conditions. A spring-loaded check valve (such as 75 in the Tachick et al patent) is normally used in the port 69, but has been omitted in FIG. 1 to simplify the drawing.

As pointed out in the Tachick et al patent, the provision of keyribs in the wall of the container tube and matching keyways in the piston permits the snuffer and bore contact to be threaded out of the piston and replaced with another set of snuffer and bore contacts. Thus, the container tube with only the piston inside can be interchangeably fitted with other snuffer and bore contact combinations.

While I have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

What I claim is:

1. A separable electrical connector module for coupling with a mating connector module, comprising:

(a) an insulating housing having an elongated receiving passageway therein, and (b) a switch insert closely fitted in said passageway and comprising:

(i) a conductive container tube having an outer end adapted to receive a rod contact member of said mating connector module and an inner end;

(ii) a snuffer tube in said container tube having a central bore for receiving said rod contact member and having inside said bore a layer of ablative material;

(iii) a bore contact member within said container tube having a gas port, (iv) a piston fixed to said bore contact member and adapted to drive said bore contact member toward the outer end of said container tube in response to the generation of gas by arcing in said bore and the passage of said gas through said port, said piston having angularly-spaced keyways in its outer periphery, (c) the inside wall of said container tube including a plurality of axially extending keyribs angularly spaced about the longitudinal axis of said container tube and slidably received within the keyways in said piston to prevent said piston from rotating relative to the container tube, (i) said piston comprising a generally tubular metallic portion comprising angularly-spaced segments biased radially-outwardly against the inside wall of said container tube in locations between said keyribs to establish continuous electrical contact with said inside wall while said piston is stationary and while in motion, (ii) and means biasing said segments radially outward comprising a split annular metal spring located radially inwardly of said segments and tending to expand in diameter and urge said segments radially outward.

2. The connector module of claim 1 in which said segments are of copper and said split annular metal spring is of stainless steel.

3. The connector module of claim 1 in which at least some of said segments include at their free ends a radially inwardly extending lip portion that retains said annular spring against axial motion within said piston.

4. The connector module of claim 1 in which:

(a) said segments surround a bore of said piston and have recesses facing said bore and collectively defining an annular recess in said bore, and (b) said annular metal spring is located in said recess.

* * * * *